US009089179B2

(12) United States Patent
Tagg

(10) Patent No.: US 9,089,179 B2
(45) Date of Patent: Jul. 28, 2015

(54) SUPPORT HAT

(76) Inventor: John P. Tagg, Pittsburgh, PA (US)

( * ) Notice: Subject to any disclaimer, the term of this patent is extended or adjusted under 35 U.S.C. 154(b) by 1146 days.

(21) Appl. No.: 12/592,333

(22) Filed: Nov. 23, 2009

(65) Prior Publication Data

US 2010/0281600 A1 Nov. 11, 2010

Related U.S. Application Data

(60) Provisional application No. 61/177,074, filed on May 11, 2009.

(51) Int. Cl.

| | |
|---|---|
| ***A42B 1/04*** | (2006.01) |
| ***A42B 3/04*** | (2006.01) |
| ***A42B 1/24*** | (2006.01) |

(52) U.S. Cl.

CPC ..... *A42B 3/0473* (2013.01); *A42B 1/24* (2013.01)

(58) Field of Classification Search

CPC ..... A42B 1/24; A42B 3/0473
USPC ..... 297/219.12, 393; 2/171, 311; 602/17; 128/97.1, 845, 857, 871; 5/622, 636, 5/637

See application file for complete search history.

(56) References Cited

U.S. PATENT DOCUMENTS

| | | | | |
|---|---|---|---|---|
| 1,551,322 | A * | 8/1925 | O'Donnell | 2/195.5 |
| 4,707,031 | A | 11/1987 | Meistrell | |
| 5,511,854 | A * | 4/1996 | Cordia | 297/393 |
| 5,519,892 | A * | 5/1996 | Pizzacar | 2/195.2 |
| 5,580,133 | A | 12/1996 | Knox et al. | |
| 6,266,825 | B1 | 7/2001 | Floyd | |
| 6,301,716 | B1 | 10/2001 | Ross | |
| 6,386,639 | B1 * | 5/2002 | McMichael | 297/464 |
| 6,607,245 | B1 * | 8/2003 | Scher | 297/393 |
| 6,799,802 | B1 | 10/2004 | Moran | |
| 7,530,634 | B1 | 5/2009 | Mortazavi et al. | |
| D615,453 | S * | 5/2010 | Spears | D11/200 |
| 2002/0067063 | A1 | 6/2002 | Taborro | |
| 2004/0124685 | A1 | 7/2004 | Buch | |
| 2005/0268377 | A1 * | 12/2005 | Massey | 2/209.13 |
| 2006/0061186 | A1 | 3/2006 | Funke, III et al. | |
| 2006/0082205 | A1 * | 4/2006 | Hobson | 297/393 |
| 2007/0245457 | A1 * | 10/2007 | Gelera | 2/181 |
| 2010/0237675 | A1 * | 9/2010 | Merritt | 297/393 |
| 2011/0101761 | A1 * | 5/2011 | Demaras | 297/393 |

* cited by examiner

*Primary Examiner* — Anna Kinsaul
(74) *Attorney, Agent, or Firm* — Carothers and Carothers

(57) ABSTRACT

A support hat for maintaining a person's head upright. The support hat is comprised of a fabric cap for snugly engaging the person's head and a support strap passes through spaced openings in the back of the cap, and the strap has two tether ends that extend from the spaced openings for securing the cap to a seat back. The support strap tethers are releaseably secured together with a fastener inside the cap whereby the cap may be released from the tethers so that the cap may be worn independently of the support strap, leaving the support strap secured to the seat back. A bottom annular hem is provided in the cap with an annular band of stiffener material secured therein and fully therearound. This keeps the hat from distorting and sliding off the head of the baby, child, infant, or person with disability.

9 Claims, 2 Drawing Sheets

SUPPORT HAT

CROSS REFERENCE

This application claims the benefit of U.S. Provisional Patent Application No. 61/177,074, filed Nov. 21, 2008, entitled SUPPORT HAT, the content of which is incorporated herein in its entirety.

BACKGROUND OF THE INVENTION

The present invention relates to head restraints, and more particularly to a support hat for securely holding the head of a baby, an infant, child or person with disability upright.

Infants and individuals with poor musculoskeletal control have difficulty holding their head in an upright position. With infants, this can become a problem when the child is seated in a car seat or stroller, and with a disabled adult, the device of the present invention can be utilized with a wheelchair or similar patient chair.

Problems encountered with present day head restraint assemblies, are that the assemblies of the prior art do not provide a hat which can be easily detached from the restraint devices so the hat may be used independently, and the hat portions thereof do not maintain a snug fit and come off the wearer's head too easily. Overall, the prior art head restraints are not user friendly.

SUMMARY OF THE INVENTION

The support hat of the present invention is provided for maintaining a person's head upright and is comprised of a fabric cap which snugly engages the person's head, and a support strap passes through spaced openings in a back portion of the cap. The support strap has two tether ends extending respectively from the spaced openings of the cap for securing the cap to a seat back. The support strap tethers are releasably secured together with a fastener inside the cap whereby the cap may be released from the tethers, leaving them attached to the seat back, so that the cap may be worn independently of the support strap.

To facilitate in the ability of the cap to not overly deform and dislodge from the wearer's head, the cap includes a bottom annular hem with an annular band of stiffener material secured therein and fully therearound. A removable fabric comfort cover is secured over this inside fastener on the inside of the cap so that the fastener is comfort isolated from the wearer's head. This inside fastener is preferably comprised of a quick release squeeze buckle, sometimes referred to as a plastic double sided release buckle. The distal ends of the support strap tethers are also preferably provided with an adjustable double-D fastener for adjustably securing the distal ends together on the back side of a seat back. In fact, the seat back may be provided with spaced pre-positioned apertures for passage therethrough of the strap tether distal ends for securement together on the back side of the seat back. Also, multiple seat backs for respective seat devices, such as car seats, strollers etc., may be each preprovided with a support strap so that the cap may be moved from one sealing device to another without having to reassemble the support strap.

The cap may be composed of any suitable material, such as cotton, polyester, mesh, or any suitable cloth material. However, cotton is preferred for its comfort capabilities and its ability to allow heat to escape.

BRIEF DESCRIPTION OF THE DRAWINGS

Other objects and advantages appear hereinafter in the following description and claims. The accompanying drawings show, for the purpose of exemplification, without limiting the scope of the invention or the appended claims, certain practical embodiments of the present invention wherein:

DETAILED DESCRIPTION OF A PREFERRED EMBODIMENT

Figure 1:
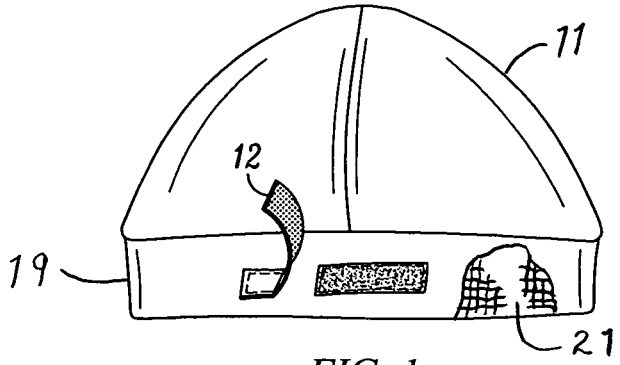
FIG. 1 is a side view of the support hat of the present invention, with the support strap removed and a portion of the base hem cut away to reveal the band of stiffener material.
Figure 2:
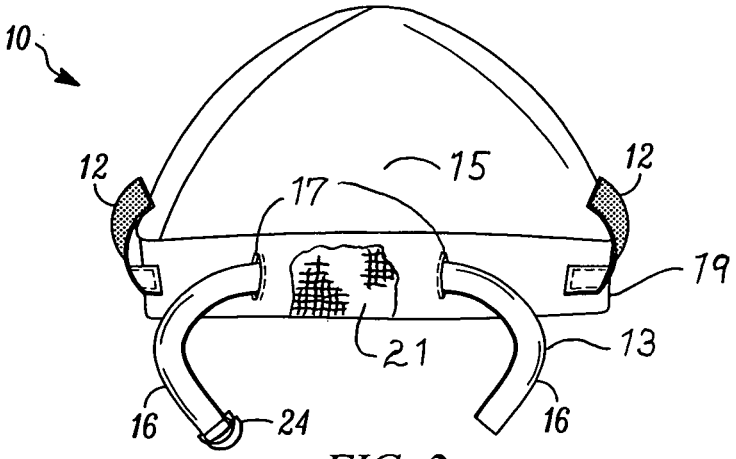
FIG. 2 is a back view of the support hat, with a portion of the base hem cut away to reveal the band of stiffener material.
Figure 4:
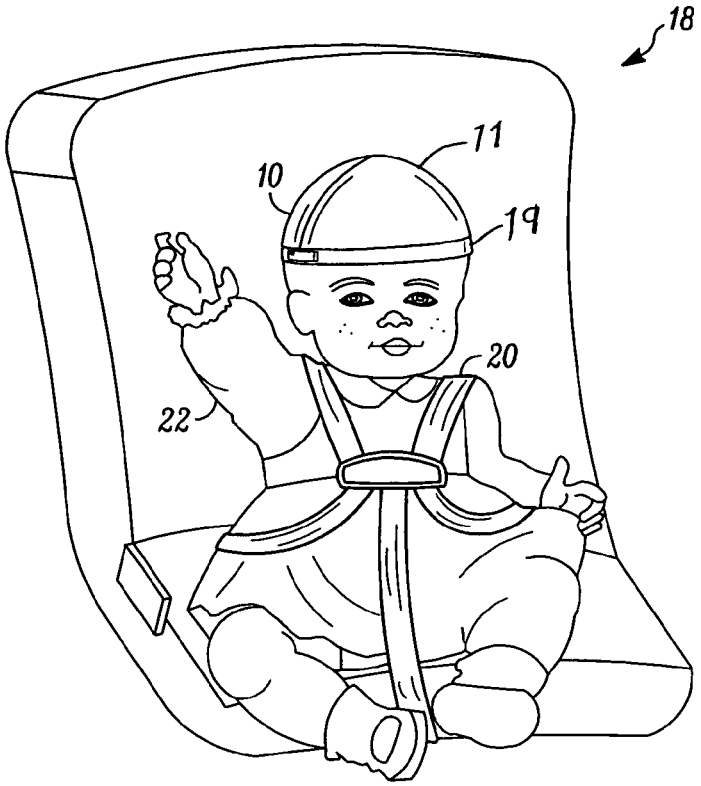
FIG. 4 is a perspective view illustrating a practical application of the support hat of the present invention in combination with an infant car seat.

Referring to the drawings, the support hat 10 of the present invention is provided to maintain a person's head upright. The support hat 10 is comprised of a fabric cap 11 for snugly engaging a person's head, such as an infant 22, as illustrated in FIG. 4. The cap 11 is constructed of any suitable material, such as cotton, polyester, mesh, or other suitable cloth material or fabric. The cap 11 is also provided with two or more Velcro hook and loop adjusters 12 that are sewn into the front (FIG. 1) or the sides (FIG. 2) of the cap 11 for adjusting the size of the cap 11 to snugly engage the wearer's head.

Figure 5:
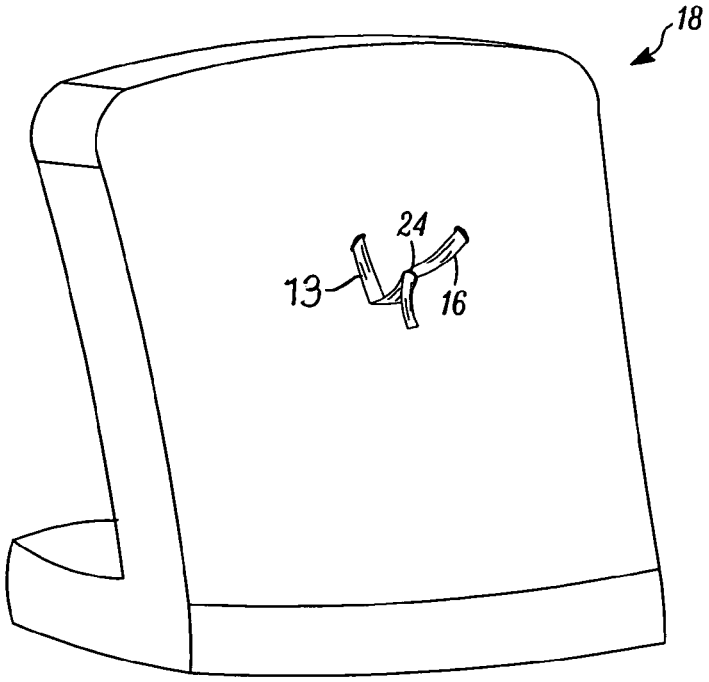
FIG. 5 is a perspective view of the reverse or back side of the embodiment illustrated in FIG. 4.

A support strap 13 passes through the spaced openings 17 and the back portion 15 of cap 11. The support strap 13 has two tether ends 16 respectively extending from the spaced openings 17 of cap 11 for securing the cap to a seat back as illustrated in FIG. 5. In this embodiment, the seat back is illustrated as the seat back of an infant car seat 18. Openings 17 are provided with extra stitching therearound to prevent distortion and/or tearing.

Figure 3:
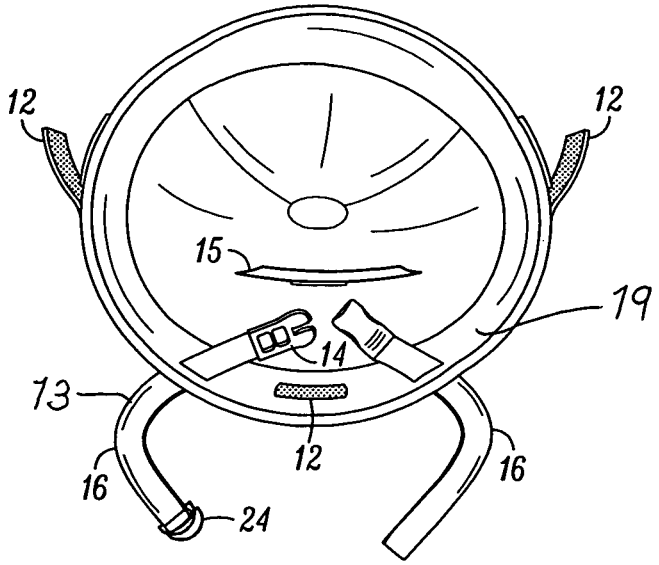
FIG. 3 is a bottom inside view of the support hat.

The support strap tethers 16 are releaseably secured together with a fastener 14 inside cap 11 as illustrated in FIG. 3, whereby the cap 11 may be released from the tethers 16, which are otherwise attached to the seat back of car seat 18 (FIG. 5) so the cap may be worn by the infant independently of the support seat.

In other words, as illustrated best in FIG. 4, when the infant 22 is to be removed from the car seat 18, the typical safety harness 20 is unfastened and moved and the child cap 11 is removed from the head of the child or infant 22. The fastener 14 is then unfastened and the inside fastener ends of fastener 14 are pulled through openings 17 so that the cap 11 may be placed back on the head of the infant 22 for normal wear independently of the support strap 16.

The fastener 14 (FIG. 3) is here illustrated as a plastic quick release squeeze buckle, sometimes referred to as a double sided release buckle which is readily found on the market. In order to protect the infant's head from engagement with the fastener 14, a comfort cover 15 is secured thereover inside the cap 11 with Velcro hook and loop attachment 12. Comfort cover 15 is shown as a separate item, but may be secured as a hingable flap inside the cap 11 having a top edge thereof sewn to the inside of the cap as a hinge.

In order to insure that the soft fabric cap 11 (FIG. 4) will not too easily come off the head of the infant 22, and to further insure that the cap 11 will better hold its shape and snugly engage the infant's head, the cap 11 includes a bottom annular base hem 19 which encloses therein an annular band 21 of stiffener material which is secured therein fully around the perimeter of the cap 11. This band may be composed of any suitable stiffener material, such as sold under the trademark Pellon or Beltex 71 by Pellon Consumer Products of Tucker, Ga. It may also consist of thin strap material.

The support strap 13 is constructed of any suitable strong strap material which does not slip when secured with the double-D ring fastener 24, such as woven polyurethane strap. Polypropylene is preferred. The support strap 13 and the cap 11 may be sold together or separately.

I claim:

1. A support hat for maintaining a person's head upright, comprising:

a fabric cap for snugly engaging a person's head; and a support strap passing through spaced openings in a back bottom hem portion of said cap and having two tether ends extending respectively from the spaced openings of said cap for securing said cap to a seat back;

said support strap tethers releaseably secured together with a fastener inside said cap whereby said cap may be released from said tethers when attached to a seat back so that the cap may be worn independently of said support strap.

2. The support hat of claim 1, said cap including a bottom annular hem with an annular band of stiffener material secured therein and fully therearound.

3. The support hat of claim 2, said cap including a removable fabric comfort cover secured over said fastener on the inside of said cap.

4. The support hat of claim 3, said cover consisting of a flap.

5. The support hat of claim 1, said fastener comprised of a quick release squeeze buckle.

6. The support hat of claim 1, wherein distal ends of said support strap tethers are provided with an adjustable double-D fastener for adjustably securing said distal ends together.

7. The support hat of claim 1, said seat back having spaced pre-positioned apertures for passage therethrough of said strap tether distal ends for securement together on a back side of said seat back.

8. The support hat of claim 7, wherein said seat back is part of an infant car seat or a wheelchair.

9. The support hat of claim 1, wherein said cap is composed of a cotton fabric.

* * * * *